United States Patent [19]

Alloca et al.

[11] Patent Number: 4,505,647

[45] Date of Patent: Mar. 19, 1985

[54] VACUUM PUMPING SYSTEM

[75] Inventors: Robert E. Alloca, Melville; Meyer I. Mazon, Flushing, both of N.Y.

[73] Assignee: Grumman Allied Industries, Inc., Melville, N.Y.

[21] Appl. No.: 138,238

[22] Filed: Apr. 7, 1980

Related U.S. Application Data

[63] Continuation of Ser. No. 872,613, Jan. 26, 1978, abandoned.

[51] Int. Cl.[3] ..... F04B 49/08

[52] U.S. Cl. ..... 417/252; 417/309

[58] Field of Search ..... 417/252, 253, 69, 309

[56] References Cited

U.S. PATENT DOCUMENTS 2,683,418 7/1954 Smith ..... 417/309

3,515,164 6/1970 Dunnous ..... 417/252 X

FOREIGN PATENT DOCUMENTS 2020371 7/1970 France ..... 417/203

OTHER PUBLICATIONS

Daugherty, et al., Fluid Mechanics with Engineering Applications, McGraw-Hill, New York, 1954, pp. 22–23.

Machine Design, Dec. 15, 1966, Pressure Switches, Herbert J. Zurstadt, pp. 30, 31, 34, 35.

*Primary Examiner*—Richard E. Gluck

*Attorney, Agent, or Firm*—Richard G. Geib

[57] ABSTRACT

In a two-stage vacuum pumping system having a single drive motor powering both stages, a by-pass line connected between the container being evacuated and the interstage line between the two stages for relieving excess pressure in the interstage line during the initial pressure pull-down of the container. This reduces the load on the second stage pump and thereby lowers the power requirements of the drive motor. A pressure switch actuated solenoid valve in the by-pass line, which is in the open position during the pull-down procedure, is closed when the container is evacuated to a set-point pressure. When the by-pass line is closed off the two stages work together to pump down the container to a desired pressure below the pressure switch set point.

4 Claims, 2 Drawing Figures

VACUUM PUMPING SYSTEM

This is a continuation of application Ser. No. 872,613 filed Jan. 26, 1978, now abandoned.

BACKGROUND OF THE INVENTION

1. Field Of The Invention

The present invention relates to vacuum pumping systems and, more particularly, to a vacuum pumping system powered by a single drive motor and having two pump stages in series.

2. Summary Of The Invention

During the evacuation of a container with a two-stage vacuum pumping system powered by a single drive motor, the load on the motor is at a maximum during the initial pull-down of pressure from the ambient and the power requirements lessen substantially during the subsequent pump down of the container. Because of these differences in power requirements, the selection of an efficient drive motor to meet the needs of a conventional vacuum pumping system poses many difficulties. If a motor adequate to meet the requirements of pull-down is installed, there is a danger that the system will be inefficiently overpowered during pump down. However, to avoid overloading the motor destructively, it is conventional practice to install a motor that is larger than is required for final pump down. This consequently results in a higher first cost of the system and also an overall drop in efficiency of the installation during operation. In the subject invention, a pressure controlled bypass is provided in the interstage line between the two series-connected stages of the vacuum pumping system; excess discharge pressure from the first stage pump is relieved back to the container being evacuated to thereby reduce the load on the motor during the pull-down phase. Thus, a smaller motor that is energy-efficient during the final pump down phase can be used to drive the vacuum pumping system.

DESCRIPTION OF THE PRIOR ART

Multi-stage vacuum pumping systems are, of course, well known in the prior art. Quite commonly, where low pressures are required, diffusion pumps capable of exhausting to low pressures are placed in series with mechanical pumps which insure that the diffusion pumps are not required to work against ambient pressures. Typical examples of such an arrangement are disclosed in U.S. Pat. Nos. 1,716,160 and 2,652,188 to V. K. Zworykin et al. and R. R. Cyr, respectively. When a by-pass is used in such an arrangement, the design object as shown by Cyr is to have the mechanical pump connected directly to rough down the container being evacuated; however, the by-pass does not return a portion of the first stage output back to the container to relieve interstage pressure as is done in the present invention. As evidenced by E. W. Graham and B. Buechel et al. in U.S. Pat. Nos. 2,449,217 and 3,116,872, respectively, the use of purely mechanical pumps in series are also known in the art. Graham is of interest because he discloses a construction having a single drive motor powering two mechanical pumps in series. Graham also discloses an interstage by-pass which, however, returns a portion of the first stage output to the first stage inlet instead of to the container being evacuated as is the case in the present invention. The function of the bypass of Graham is to reduce the intake suction of the first stage pump, thus the by-pass does not reduce the load on the second stage pump by relieving interstage overpressure back to the container being evacuated to thereby reduce the power requirements of the single drive motor. Because of these factors, therefore, it is seen that it has not been appreciated in the prior art that it would be possible to minimize the power requirements in a multi-stage pumping system if the interstage pressure was relieved to effect the objects of the present invention.

OBJECTS OF THE INVENTION

It is a principal object of the invention to provide means by which a single drive motor can be used to power efficiently a multi-stage vacuum pump system during the initial pull-down phase in evacuating a container without delivering power in excess of requirements during the final pump-down phase.

It is another object of the invention to provide a multi-stage vacuum pumping system having a lower first cost and which has a reduced power draw in operation such that economies can be effected in the initial installation expense and the subsequent operating cost thereof.

It is a further object of the invention to relieve the interstage pressure in a multi-stage pumping system to thereby reduce the load on the second stage pump such that the system power requirements are minimized.

DESCRIPTION OF THE DRAWINGS

For the purpose of illustrating the invention, there are shown in the drawings the forms which are presently preferred, it should be understood, however, that the invention is not necessarily limited to the precise arrangements and instrumentalities here shown.

DESCRIPTION OF THE PREFERRED EMBODIMENTS

Figure 1:
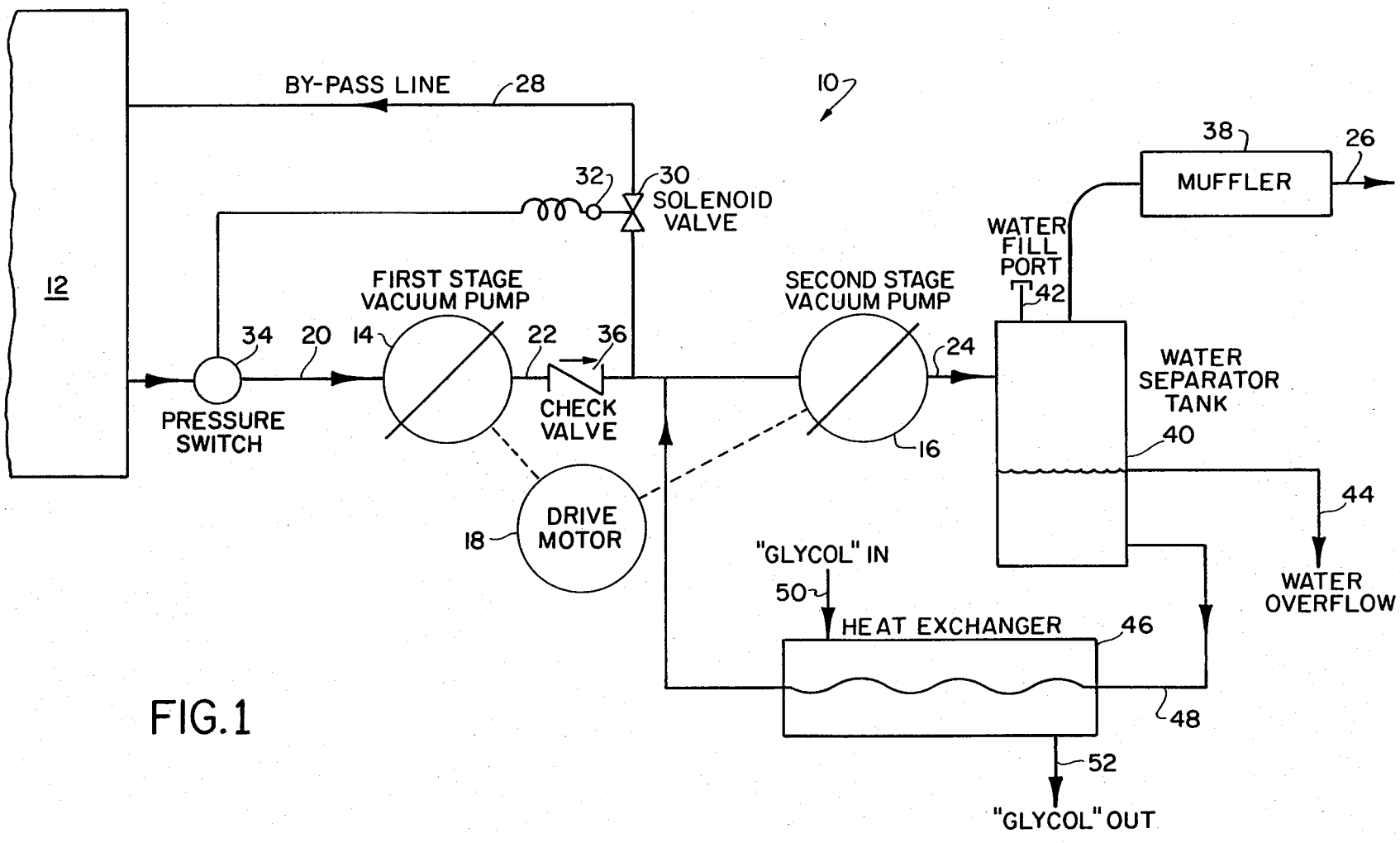
FIG. 1 is a schematic of a multi-stage vacuum pumping system of the invention.

Referring now to the drawings, FIG. 1 illustrates the invention embodied in a pumping system 10 for evacuating a chamber or container 12. System 10 includes a two-stage vacuum pump assembly having a first stage pump 14 and a second stage pump 16 both powered by a drive motor 18 through suitable means such as a belt drive arrangement (not shown). The inlet to first stage pump 14 is connected to a line 20 which is in communication with container 12 which is to be evacuated and the outlet of the pump is connected to the second stage pump 16 by interstage line 22. The second stage pump is provided with an output line 24 having an outlet 26 opening to the atmosphere. Connected into interstage line 22 is a by-pass line 28 which leads back to container 12. A by-pass valve 30 operated by means such as a solenoid 32 in response to signals from a pressure-sensitive switch 34 in line 20 controls the flow through by-pass line 28.

In operation, the motor 18 of the two-stage vacuum pump assembly is started and the first stage 14 and second stage 16 pumps thereof begin the pull down of the pressure in container 12. When pump operation is initiated, the by-pass valve 30 is open such that excess pressure in the interstage line 22 is relieved back into container 12 through the by-pass line 28. Relieving interstage pressure reduces the load on the second stage pump thereby lowering the power draw on the drive motor 18 during the container pressure pull down operation. When the pressure in the container has been reduced by the two-stage pump assembly to a predetermined set point, the pressure-sensitive switch 34 causes the solenoid 32 to be activated, closing valve 30 to stop the flow through line 28. After the by-pass is shut off the two stages of the pump assembly work together to pump down the container 12 to a desired pressure.

In an embodiment of the invention, the first stage pump 14 was a positive-displacement Rootes-blower type pump and the second stage pump 16 was a rotary liquid-ring type vacuum pump. The drive motor 18 was of an electric open dripproof type having a service factor of 1.15. The motor was rated at 26.5 amps continuous current draw at 210 volts which corresponds to 8.6 hp. A 4.5 in. diameter pulley was used to drive the first stage and there was a 1:1.50 pump speed ratio in the pulley drive between the first and second stages. Interstage line 22 was provided with a check valve 36 to prevent back pressure on the first stage pump and a muffler 38 was fitted for noise reduction on the second stage output line 24. As is usual with liquid seal-type pumps in which water is used to provide liquid compressant, a separator tank 40 having a fill port 42 and an overflow line 44 was provided. A heat exchanger 46 was provided in a water line 48 between the tank 40 and the interstage line 22 leading to the second stage pump 16 to remove the heat of compression and condensation from the system water. A heat exchange fluid such as ethelyne glycol was passed into the heat exchanger 46 through an intake 50 and circulated therefrom out of outlet 52 to a condensing system (not shown). It will be recognized that the system components such as the water separator, the heat exchanger of the liquid-ring vacuum pump, and the like are those used in common practice and it is believed that no useful purpose will be served by a detailed description of the components or the operation thereof.

In test runs in which the by-pass line 28 was shut off to duplicate the performance of a two-stage vacuum pump system of conventional design, the motor in operation drew 9.5 hp maximum, which was approximately 10.2% higher than the maximum allowable. The maximum pressure increase ($P_2$–$P_1$) was about 224 mm Hg when the pressure ($P_1$) of the container 12 was 540 mm Hg. The maximum temperature rise at the first stage pump housing was 69° F.

Figure 2:
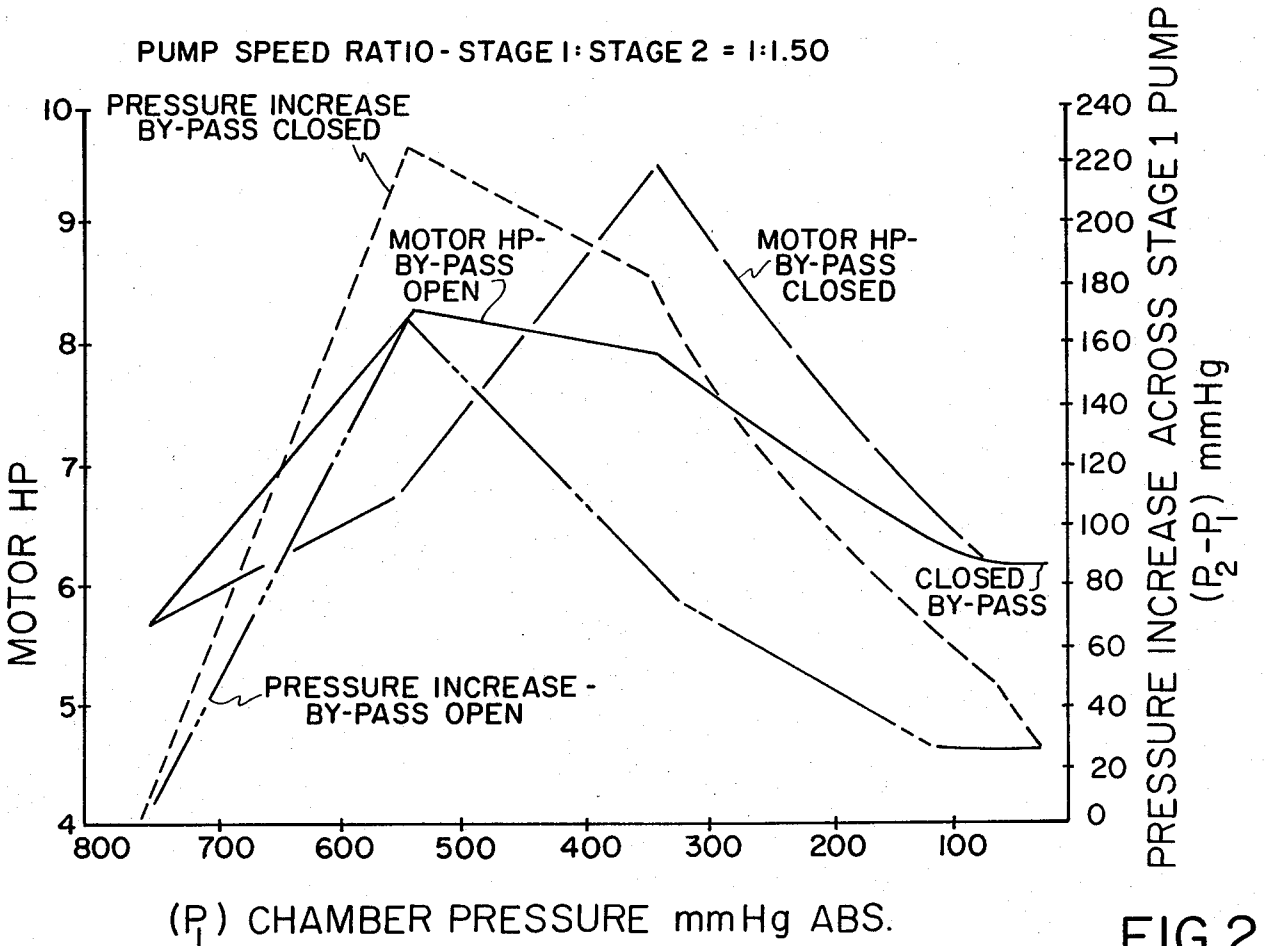
FIG. 2 is a plot of performance characteristics of a two-stage vacuum pumping system both with and without the by-pass means of the invention.

In test runs with the by-pass line as embodied in the invention open during pull down, the motor drew 8.3 hp maximum which was within the service factor by 3.6%. The maximum pressure increase across the first stage pump ($P_2$–$P_1$) was 168 mm Hg when the chamber pressure ($P_1$) was 540 mm Hg and the maximum temperature rise at the first stage pump housing was 8° F. A comparison of system performance with and without a by-pass to illustrate the improvement brought about by our invention is plotted in FIG. 2.

Although shown and described in what is believed to be the most practical and preferred embodiments, it is apparent that departures from the specific method and apparatus described will suggest themselves to those skilled in the art and may be made without departing from the spirit and scope of the invention. We, therefore, do not wish to restrict ourselves to the particular constructions illustrated and described, but desire to avail ourselves of all modifications that may fall within the scope of the appended claims.

Having thus described our invention, what we claim is:

1. A vacuum pumping system for evacuating a container comprising:

a pumping system having at least first stage and second stage pumps and an interstage line therebetween connecting the output of said first pump with the input of said second pump;

a motor for driving said pumps;

a by-pass line connecting said interstage line with said container for returning selectively at least some of the output of said first pump to said container;

valve means in said by-pass line for opening or closing said by-pass line;

an intake line for the passage of fluid between said container and the input of said first stage pump; and pressure-sensitive switching means in said intake line responsive to absolute pressure for actuating said valve means in response to a preset absolute pressure level to close said valve when said container is evacuated to said preset absolute pressure whereby, when said valve is open, interstage pressure is relieved back to said container such that the power requirements of said system are minimized during the initial pressure pull-down of said container and whereby, when said valve is closed when said preset pressure is reached, said two stages work together to pump down efficiently said container to a desired absolute pressure below said preset pressure.

2. The apparatus of claim 1 wherein the pumping system is a two-stage system comprising first and second vacuum pumps driven by a single drive motor.

3. The apparatus of claim 1 wherein the pumps are mechanical pumps.

4. The apparatus of claim 1 wherein said absolute pressure characterizes the pressure in said container.

* * * * *